United States Patent [19]

Rüsch et al.

[11] 4,225,093

[45] Sep. 30, 1980

[54] ROLLING MILL FOR MILLING CEREALS AND SIMILAR MATERIAL

[75] Inventors: Friedrich-Wilhelm Rüsch; Johannes Gärtner, both of Brunswick; Walter Faist, Vechelde, all of Fed. Rep. of Germany

[73] Assignee: Buehler-Miag GmbH, Brunswick, Fed. Rep. of Germany

[21] Appl. No.: 13,526

[22] Filed: Feb. 21, 1979

Related U.S. Application Data

[63] Continuation-in-part of Ser. No. 878,919, Feb. 17, 1978, abandoned.

[51] Int. Cl.[3] ..... B02C 4/28

[52] U.S. Cl. ..... 241/76; 241/159; 241/285 R

[58] Field of Search ..... 241/76–78, 241/159, 227, 285 R, 285 B

[56] References Cited

U.S. PATENT DOCUMENTS

| | | | |
|---|---|---|---|
| 344,258 | 6/1886 | Dunne | 241/285 R |
| 1,743,911 | 1/1930 | Borton | 241/285 A |
| 2,343,270 | 3/1944 | Agnew | 241/76 X |
| 3,070,318 | 12/1962 | Blanchard | 241/76 X |
| 3,190,572 | 6/1965 | Goto | 241/159 X |
| 3,899,965 | 8/1975 | Koch et al. | 241/285 B X |

FOREIGN PATENT DOCUMENTS

| | | | |
|---|---|---|---|
| 2610742 | 9/1977 | Fed. Rep. of Germany | 241/285 R |

*Primary Examiner*—Howard N. Goldberg
*Attorney, Agent, or Firm*—Michael J. Striker

[57] ABSTRACT

A rolling mill for milling cereals or the like, comprises three roll units, each including two rolls and bearings mounting the rolls for rotation about parallel axes, a housing provided with three outwardly open receiving portions for frontal insertion of the roll units and for supporting the latter after insertion. The receiving portions are vertically spaced from each other with two receiving portions having open ends at one side of the housing and a third of the receiving portions, located between the other two, having an open end at the opposite side of the housing. The rolling mill includes further treating devices in the housing between successive roll units and such treating devices may be constituted by swinging sieves.

10 Claims, 3 Drawing Figures

ROLLING MILL FOR MILLING CEREALS AND SIMILAR MATERIAL

CROSS-REFERENCE TO RELATED APPLICATION

The present application is a continuation-in-part application of the copending application Ser. No. 878,919, filed Feb. 17, 1978, now abandoned.

BACKGROUND OF THE INVENTION

The present invention relates to a rolling mill for milling cereals or similar material and including a housing and a plurality of pairs of rolls exchangeably arranged in the housing.

In the usual construction of such rolling mills, the pairs of rolls of the mills are mounted in a cast housing or in a housing welded together from sheet material, whereby the bearings for the rolls are received individually in the housing and fixed to the latter. Thereby the housing has not only to take-up the forces resulting from the weight of the rolls and the drive means therefor, but also the forces resulting from the milling process per se, which in turn will result in heavy expensive machines. If, in such a construction, one of the rolls of a pair of rolls has to be exchanged, due to wear or a defect in one of the rolls or in a roll pair, it is necessary to dismantle all bearings, resulting in a cumbersome and time-consuming operation and requiring a plurality of operators for carrying out such an exchange.

In order to simplify an exchange of the rolls and to carry out such an exchange in a shorter time, rolling mill housings are known in the art which are split in the region of the roll bearings so that, after removal of one housing part, the bearings of all rolls are easily accessible and so that the rolls together with the bearings may be removed from the housing. Such constructions are, for instance, shown in the German Pat. Nos. 671,248 and 840,790. While in these constructions any necessary exchange of the rolls is simplified, these constructions require expensive housings, so that the aforementioned constructions have not been accepted by the trade.

A construction for rolling mills is further known in which the housing, formed from welded steel sheets, is provided with circular openings in two opposite walls thereof, through which the rolls of a roll pair are inserted. Compact drive heads, which include the bearings for the roll pair as well as parts of the drive for rotating the latter, are placed into the circular openings and releasably connected by screws to the housing. In order to remove the roll pair, the two drive heads are disconnected from the housing and the rolls pulled in axial direction through the aforementioned opening out of the housing. Such a construction is, for instance, shown in the German Pat. No. 440,927.

Rolling mills are further known in the art in which the rolls thereof are supported in a usual manner at one end in separate bearings mounted on one side wall of the housing, and in which the other end of each roll is mounted in a bearing which is received in a cover plate connected to the opposite side wall of the housing, and in which the cover plate closes an opening in the other side wall which corresponds to the diameter of the respective roll, so that the roll, after removing of the cover plate, may be moved in axial direction into or removed from the housing. Such a construction is, for instance, disclosed in the German Pat. No. 926,383.

Common to all these known rolling mills is that the housing as well as the roll set or sets have to be individually constructed for the respective purpose and must be correspondingly harmonized with each other. Such a necessary individual construction is evidently detrimental as far as an economical manufacturing or quick repairs are concerned.

SUMMARY OF THE INVENTION

It is an object of the present invention to provide a rolling mill for milling cereals or similar material and which avoids the disadvantages of such rolling mills known in the art.

It is a further object of the present invention to provide a mechanical assembly technique for rolling mills, which permits to construct the roll pairs, as well as the housing in series and to maintain the standard units in stock, so that the units may be in the shortest time assembled to rolling mills for different purposes and in the event of a defect or excessive wear of one of these units be quickly exchanged by taking another unit from stock.

It is an additional object of the present invention to provide a rolling mill having a plurality of roll units arranged in the housing vertically and laterally spaced from each other to provide between successive roll units the necessary space for treatment means of the material to be milled as the material passes from one roll unit to the next.

With these and other objects in view, which will become apparent as the description proceeds, the rolling mill according to the present invention for milling cereals or similar material mainly comprises three roll units, each including two rolls and bearings mounting the rolls rotatable about parallel axes, housing means provided with three outwardly open receiving means for frontal insertion of the roll units and for supporting the latter after insertion, in which the receiving means are arranged in the housing means vertically and spaced from each other, with two of said outwardly open receiving means having open ends at one side of the housing means and a third of the outwardly open receiving means, which is located between the other two, having an open end located at the opposite side of the housing means, inlet means for passing the material to be milled into the gap between the rolls of the uppermost roll unit, outlet means for discharging the milled material located below the lowermost of the roll units, and treatment means extending transversely through the housing for treating the material between successive roll units.

Thereby it is essential that each of the roll units forms a closed system, that is that the forces during the rolling process compensate each other so that no milling forces will act on the housing, and in which each roll unit forms a compact construction which includes not only the two rolls, one of which may be moved toward and away from each other, but also all necessary bearings, links and any safety elements, any necessary adjustment means, means for moving the material to be milled into the nip between the two rolls, as well as the necessary elements for driving the rolls so that each roll unit may be assembled with, respectively removed from, the housing as a unit. To combine the rolls of rolling mills to a constructive unit in which the forces form a closed system, is in principle known (German Pat. No. 854,872) and the roll units of the above-mentioned construction, per se, are not an object of the present invention, but the use of such roll units with a housing according to the present invention to form with the latter an assembly of prefabricated machine parts for rolling mills.

By arranging the plurality of roll units of the rolling mill according to the present invention vertically and spaced from each other in outwardly open receiving means in the manner as set forth above, the roll units of the rolling mill may not only easily be exchanged, but there is also provided within the housing between successive roll units the necessary space for treatment means for treating the material between successive roll units. Such treatment means may be constituted by sieve means, which preferably are mounted for swinging movement between one and the opposite side of the housing and such an arrangement includes drive means connected to the sieve means for imparting to the latter a swinging movement.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
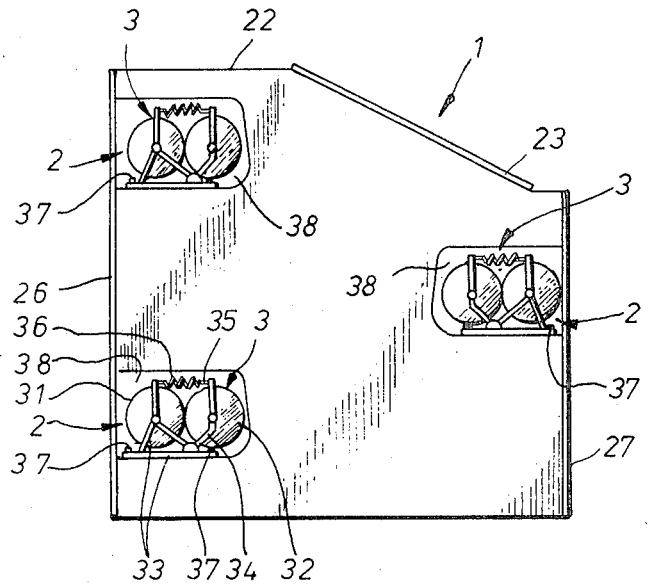
FIG. 1 is a schematic side view of a rolling mill in the form of a six roll malt grinding mill, whereby the cover plate for the cutouts in the covering of the housing are omitted.

FIG. 1 schematically illustrates a rolling mill according to the present invention, shown as a six roll malt mill, comprising a housing 1 with two outwardly open receiving means 2 at its front side and a third receiving means on its back side, as well as three roll units 3, respectively mounted in the aforementioned receiving means 2. As clearly shown in FIG. 1, the three roll units are vertically spaced from each other with the middle roll unit located also laterally spaced from the other two roll units.

Figure 2:
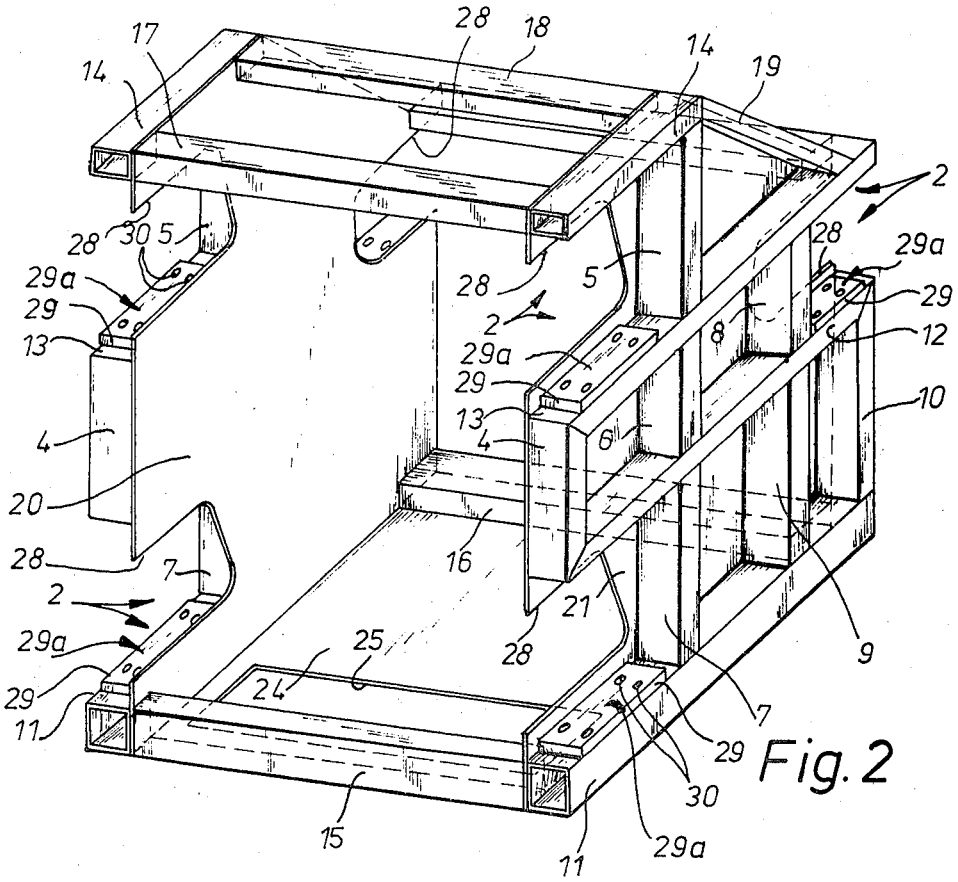
FIG. 2 illustrates the housing of the mill shown in FIG. 1 in a simplified perspective view.

As shown in FIG. 2, the housing 1 comprises a carrying frame with a covering connected thereto. The carrying frame is welded from standard hollow profiles and comprises on each side of the frame three vertical members composed of profile parts 4–10, four horizontal beams 11–14, two lower transverse members 15 and 16 respectively extending between the lowermost beams 11 on each side of the frame, two upper transverse members 17 and 18 extending between opposite ends of the uppermost beams 14, as well as two inclined members 19 respectively extending from the uppermost beam 14 toward the beam 13 downwardly spaced therefrom. The covering of the housing 1 is formed by a left side wall 20, a right side wall 21, an upper cover 22 (FIG. 1), a hinged upper plate 23, a bottom plate 24 with the discharge opening 25 (FIG. 2), with which a conveyor, not shown in the drawing, communicates, as well as front doors 26 and rear doors 27 (FIG. 1). Each of the side walls 20 and 21 is provided with three cutouts 28. The beams 11, 12 and 13 are each provided in the region of the cutouts 28 with rectangular support plates 29, welded thereto and each provided with four tapped bores 30 and an upper finished surface **29*a*. Each pair of transversely spaced beams 11, respectively 12, respectively 13, together with their support plates 29 and the coordinated cutouts 28 and the side walls 20, 21, constitutes a receiving means 2 for a roll unit 3**.

All of the three roll units 3 are constructed in the same manner and they comprise, in a manner known per se, a first roll 31 mounted in stationary bearing block 33 and a second roll 32 mounted in two tiltable bearing levers 34, connected to the stationary bearing block 33. The bearing blocks 33 are respectively connected by a mechanical linkage 35, with safety elements in form of coil springs 36, with the coordinated bearing levers 34, so that between the rolls 31, 32, the bearing block 33 and the bearing levers 34 a closed system is formed, in which the forces acting on the rolls 31 and 32 during the milling operation compensate each other. The bearing blocks 33 rest on the support faces **29*a* of the support plates 29 on the beams 11, respectively 12 or 13, and are connected thereto by means of screws 37 threaded into the tapped bore 30. The fastening of the bearing blocks 33 and therewith of the roll units 3 in the respective receiving means 2 by means of the screws 37** serves only to secure the roll units against movement when the mill is tilted, as occurs, for instance, during transport and mounting of the same.

Two cover plates 38 are connected to each of the roll units in the region of opposite ends of the respective roll unit. These cover plates 38 are mounted transversely spaced from each other, corresponding to the spacing of the side walls 20 and 21, and are formed in such a way that they completely fill the cutouts 28 formed in the side walls. Preferably, the periphery of each cover plate 38 is provided with a rubber seal to thus perfectly seal the cutout 28.

If, due to wear of the rolls or any other defect of a roll unit 3, the latter has to be exchanged, the doors 26 or 27 are opened, the screws 37 unscrewed and the connection for a drive of the rolls, for instance a V-belt, is removed and the roll unit 3 frontally pulled out in its totality from the respective receiving means 2 and replaced by a new roll unit from stock, which subsequently is mounted in reverse sequence. The exchange of a roll unit can in this way be carried out in a very simple manner and in an extremly short time.

Figure 3:
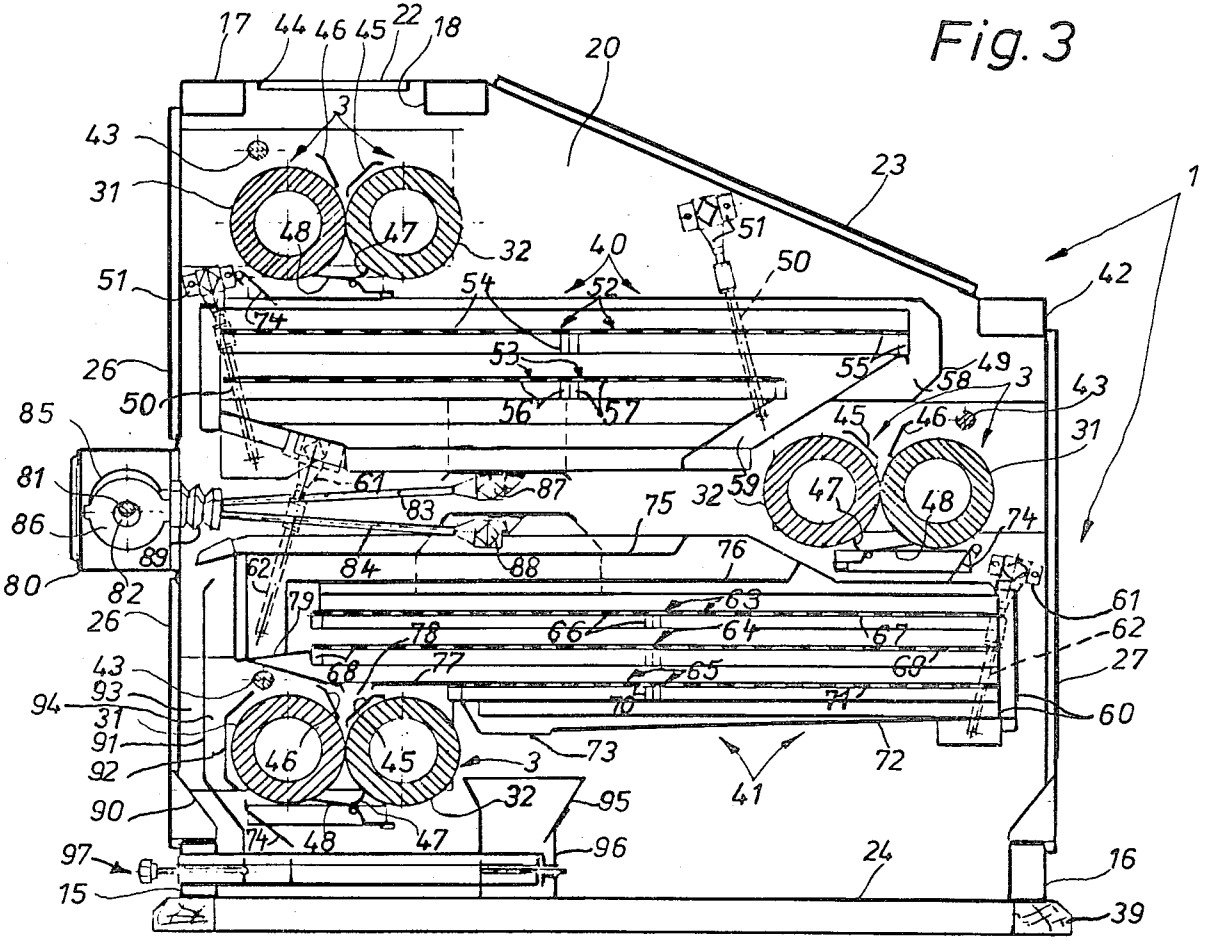
FIG. 3 is a schematic cross-section through the housing, the roll units located therein and showing in addition the treatment means in form of sieve means located between successive roll units of the mill.

FIG. 3 illustrates a cross-section through the rolling mill according to the present invention taken along a plane normal to the axes of the rolls of the roll units. For simplification reason some of the cover parts and beams of the carrying frame, described above in connection with FIG. 2, are omitted from FIG. 3. The housing 1 of the rolling mill is preferably mounted on a wooden frame 39 and FIG. 3 shows also stiffening rods 43 extending transversely through the housing for stiffening the same.

Each of the three roll units 3 is constructed as a compact unit, as described above, and each has a roll 31 mounted on a stationary bearing and a second roll 32 which is mounted and driven as described above in connection with FIG. 1. The top wall 22 of the housing is provided with an inlet opening 44 and beneath the inlet opening 44, above the nip of the uppermost roll unit 3, there are provided two stationary metal guide sheets 45, 46 which extend over the total length of the nip between the rolls of the uppermost roll unit. Beneath the nip of the rolls of the uppermost roll unit 3, there are again arranged two stationary metal sheet guides 47 and 74, as well as a tiltable, weight loaded guide flap 48, which likewise extend over the whole length of the nip between the rolls. The guide flap 48 periodically tilts under the load of the material passing between the nip of the rolls 31 and 32 of the uppermost roll unit 3 to guide the material onto the treatment means located between the uppermost roll unit 3 and the following roll units vertically and transversely spaced therefrom. The treatment means are shown in FIG. 3 as being constituted by sieve means comprising a first sieve device 40 having a sieve box 49, which is supported for swinging movement in direction transverse to the axes of the rolls on four length adjustable rods 50, which in turn are connected at upper ends by holders 51 to the housing 1. Two superimposed sieves 52 and 53 are arranged in the sieve box 49, each comprising two laterally arranged sieve frames 54, 55, respectively 56, 57, in which the upper sieve 52 is provided with a coarse mesh sieve netting and the lower sieve 53 with a fine mesh sieve netting. At the right end, as viewed in FIG. 3, the sieve box 49 is provided with two channels 58 and 59 for respectively discharging the material which is not passed through the upper, respectively the lower, sieve 52 or 53.

As shown in FIG. 3, the channel 58 leads over further sheet metal guides 45 and 46 to the nip between the rolls of the second roll unit 3, located vertically downwardly and laterally from the uppermost roll unit 3, whereas the channel 59 leads to the second sieve means 41 located between the second roll unit 3 and the lowermost roll unit located laterally and downwardly spaced therefrom. The second sieve means 41 comprises a sieve box 60 which is likewise swingingly suspended on four length adjustable rods 62 connected at the upper ends by holders 61 to the housing 1. Three superimposed sieves 63, 64, 65 are arranged within the sieve box 60, of which the uppermost sieve 63 has two sieve frames 66, 67 with a corresponding sieve netting, the second sieve 65 has two sieve frames 68, 69 with a corresponding sieve netting and the third sieve 65 has likewise to sieve frames 70, 71 with a corresponding sieve netting, in which the mesh size of the sieve nettings decreases from the uppermost to the lowermost. The sieve box 60 is provided below the sieve 65 with a collecting bottom 72 having a discharge outlet 73 and above the uppermost sieve 63 with two superimposed collecting bottoms 75 and 76. The upper collecting bottom 75 is shorter than the lower one and is arranged to receive the material passing through the sieve 53 of the upper sieve device 40, whereas the collecting bottom 76 is arranged to receive the material passing through the channel 59. An overflow guide 77 is arranged laterally, to the left as viewed in FIG. 3, of the sieve 65 for guiding the material which does not pass through the sieve 65 through the opening 78 and additional guide sheets 45 and 46 inbetween the nip of the rolls of the lowermost roll unit 3 and laterally of the sieve 64 is an overflow guide 79 for guiding the material which has not passed through the sieve 64 into a channel 94 arranged laterally, to the left as viewed in FIG. 3, of the lowermost roll unit 3.

The sieve devices 40 and 41 are driven from a common swing drive which comprises a shaft 81 mounted for rotation in a housing part 80 projecting laterally from the housing 1 and driven over a transmission of known construction, not shown in the drawing, from an electric drive motor driving the rolls of the three roll units 3, which drive motor is likewise not shown in the drawing. Four eccentrics 82, of which only two are shown in FIG. 3, are fixed to the shaft 81 for rotation therewith, and each of the eccentrics 82 is surrounded by an eccentric head 85, respectively 86, which are respectively connected by connecting rods 83, respectively 84, and swing elements 87, respectively 88, to the boxes 49 and 60 of the sieve devices 40 and 41. A sealing sleeve 89 seals the connection between each of the heads 85 and 86 and the respective connecting rods 83 and 84.

Three walls 90, 91 and 92 arranged in the housing 1 laterally of the lowermost roll unit 3 form two channels 93 and 94, of which the channel 92 receives the material from the collecting bottom 75, whereas the channel 94 receives the material passing over the overflow guide 79. A receiving funnel 95 is arranged within the housing 1 below the outlet opening 73 of the collecting bottom 72 and the receiving channel 95 is provided at the lower end thereof with a discharge tube 96. A sample taking device 97 arranged in the housing near the bottom 24 serves for taking samples of the material passing either through the channel 93, 94 or through the discharge tube 96.

The above-described rolling mill will be operated as follows:

During operation thereof the non-illustrated electric motor drives the two rolls 31 and 32 of each roll unit 3, as well as the shaft 81 of the swing drive of the two sieve devices 40 and 41.

The material to be milled, for instance malt grain, is fed into the mill by means of a non-illustrated feeding device and drops through the inlet opening 44 between the metal sheet guides 45 and 46 into the nip between the rolls 31 and 32 of the uppermost roll unit 3 at which the grains are comminuted to coarse ground grit. The thus-comminuted material drops periodically over the guide flap 48 onto the upper sieve 52 of the first sieve device 40. The precomminuted product is divided by the sieve device 40 into rough grit and fine grit and the material which does not pass through the upper sieve 52 is guided through the channel 50 into the nip between the rolls 31 and 32 of the following roll unit 3 located vertically downwardly and laterally from the uppermost roll unit 3.

After a further more intensive milling of the grit during the passage between the rolls of the second roll unit 3 the material is further separated by the three sieves 63, 64 and 65 into chaff, rough grit and fine grit. The chaff and the fine grit leave the mill by the channels, 93, respectively 94 or 96, whereas the rough grit is further comminuted by the rolls of the lowermost roll unit to the desired fineness and fed from there into the discharge channel.

It will be understood that each of the elements described above, or two or more together, may also find a useful application in other types of rolling mills for milling cereals or similar material differing from the types described above.

While the invention has been illustrated and described as embodied in a rolling mill having three roll units each comprising two rolls rotating about parallel axes in which the roll units are arranged in a housing vertically and laterally spaced from each other with treatment means arranged in the housing between successive roll units, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this nvention.

What is claimed as new and desired to be protected by Letters Patent is set forth in the appended claims:

1. A rolling mill for milling cereals and similar material comprising three roll units, each including two rollers and bearings mounting said rollers rotatably about parallel axes; housing means provided with three outwardly open receiving means for frontal insertion of said roll units and for supporting the latter after the insertion, said receiving means being arranged in said housing means vertically spaced from each other, with one of said receiving means located between the uppermost and the lowermost receiving means also laterally spaced from said uppermost and said lowermost receiving means, said one receiving means having an open end at one side of the housing means and the other two receiving means having open ends at the other side of said housing means; inlet means for passing the material to be milled into the gap between the rollers of the uppermost roll unit; outlet means for discharging the milled material located below the lowermost of said roll units; and treatment means extending transversely through said housing means for sifting the material between successive roll units.

2. A rolling mill as defined in claim 1, wherein said housing means comprises a carrying frame including a plurality of vertically spaced pairs of horizontally extending beams, with said beams in each pair transversely spaced from each other, and covering means connected to said carrying frame, and wherein each of said receiving means comprises a respective one of said pair of beams and cut-outs in said covering in the region of the respective pair of beams for frontal insertion of a roll unit to be supported on the respective pair of beams.

3. A rolling mill as defined in claim 2, wherein said receiving means further comprises support plates fixedly connected to said beams and having upper finished surfaces for supporting said roll unit.

4. A rolling mill as defined in claim 2, and including cover plates at opposite ends of each roll unit for closing said cutouts when said roll units are mounted on said beams.

5. A rolling mill as defined in claim 1, wherein said treatment means are constituted by sieve means.

6. A rolling mill as defined in claim 5, and including means mounting each of sid sieve means for swinging movement in a direction transverse to the axes of said rolls.

7. A rolling mill as defined in claim 6, wherein said mounting means for each of said sieve means comprises a plurality of support rods, each tiltably connected at opposite ends to said housing means and said sieve means, respectively.

8. A rolling mill as defined in claim 6, and including drive means connected to said sieve means for imparting a swinging movement to the latter.

9. A rolling mill as defined in claim 8, wherein said drive means comprise a drive shaft, a plurality of eccentrics mounted on the drive shaft for rotation therewith and a plurality of connecting rods each having at one end a connecting head extending about the respective eccentric and being tiltably connected at the other end to the respective sieve means.

10. A rolling mill as defined in claim 5, wherein each of said sieve means comprises at least two superimposed sieves of which the upper one is a coarse mesh sieve and the lower one is a fine mesh sieve, and means for guiding the material which does not pass through the coarse mesh sieve into the gap between the rolls of the roll unit located beneath the respective sieve means.

* * * * *